United States Patent [19]

Budzich

[11] 4,246,934

[45] Jan. 27, 1981

[54] REMOTELY CONTROLLED LOAD RESPONSIVE VALVES

[76] Inventor: Tadeusz Budzich, 80 Murwood Dr., Moreland Hills, Ohio 44022

[21] Appl. No.: 53,041

[22] Filed: Jun. 28, 1979

Related U.S. Application Data

[63] Continuation-in-part of Ser. No. 949,250, Oct. 6, 1978, Pat. No. 4,222,409, which is a continuation-in-part of Ser. No. 773,421, Feb. 28, 1977, Pat. No. 4,122,865, Ser. No. 894,111, Apr. 17, 1978, Pat. No. 4,147,178, and Ser. No. 894,112, Apr. 17, 1978, Pat. No. 4,140,152, said Ser. No. 773,421, is a continuation-in-part of Ser. No. 729,696, Oct. 5, 1976, Pat. No. 4,028,889, and Ser. No. 655,561, Feb. 5, 1976, Pat. No. 4,099,379, which is a continuation-in-part of Ser. No. 522,324, Nov. 8, 1974, Pat. No. 3,998,134, said Ser. No. 729,696, is a continuation-in-part of Ser. No. 559,818, Mar. 19, 1975, Pat. No. 3,984,979, which is a continuation-in-part of Ser. No. 377,044, Jul. 6, 1973, Pat. No. 3,882,896, which is a continuation-in-part of Ser. No. 185,146, Sep. 30, 1971, Pat. No. 3,744,517.

[51] Int. Cl.[3] ..... F15B 13/08

[52] U.S. Cl. ..... 137/596.13; 60/445; 60/452; 91/446

[58] Field of Search ..... 60/445, 452, 484; 91/446; 137/596.13

[56] References Cited

U.S. PATENT DOCUMENTS

| | | | |
|---|---|---|---|
| 3,998,134 | 12/1976 | Budzich | 137/596.13 X |
| 4,058,139 | 11/1977 | Budzich | 91/446 X |

*Primary Examiner*—Gerald A. Michalsky

[57] ABSTRACT

In a fluid throttling pressure compensated valve remote control of position of valve spool in which the total force acting on the spool is directly proportional to displacement of the spool from its neutral position, irrespective of the pressure differential between the pump pressure and the load pressure or the pressure differential between the load pressure and the reservoir pressure.

11 Claims, 8 Drawing Figures

REMOTELY CONTROLLED LOAD RESPONSIVE VALVES

This application is a continuation in part of Ser. No. 949,250 filed Oct. 6, 1978, now U.S. Pat. No. 4,222,409, for "Load Responsive Fluid Control Valve".

Ser. No. 949,250 is a continuation in part of Ser. No. 773,421, filed Feb. 28, 1977, now U.S. Pat. No. 4,122,865 and Ser. No. 894,111 filed Apr. 17, 1978 now U.S. Pat. No. 4,147,178 and Ser. No. 894,112 filed Apr. 17, 1978 now U.S. Pat. No. 4,140,152.

Ser. No. 773,421 now U.S. Pat. No. 4,122,865 is a continuation in part of Ser. No. 729,696 filed Oct. 5, 1976 now U.S. Pat. No. 4,028,889 and Ser. No. 655,561 filed Feb. 5, 1976 now U.S. Pat. No. 4,099,379.

Ser. No. 665,561 now U.S. Pat. No. 4,099,370 is a continuation in part of Ser. No. 522,324 filed Nov. 8, 1974 now U.S. Pat. No. 3,998,134.

Ser. No. 729, 696 now U.S. Pat. No. 4,028,889 is a continuation in part of Ser. No. 559,818 filed Mar. 19, 1975 now U.S. Pat. No. 984,979.

Ser. No. 559,818 now U.S. Pat. No. 3,984,979 is a continuation in part of Ser. No. 377,044 Filed July 6, 1973 now U.S. Pat. No. 3,882,896.

Ser. No. 377,044 now U.S. Pat. No. 3,882,896 is a continuation in part of Ser. No. 185,146 filed Sept. 30,1971 now U.S. Pat. No. 3,744,517.

BACKGROUND OF THE INVENTION

This invention generally relates to a remote control of a spool position of a fluid throttling valve.

In more particular aspects this invention relates to a remote control of the spool of a throttling valve, which includes compensation of positive and negative loads.

In still more particular aspects this invention relates to a remote control of a position of a valve spool, in which due to compensation and flow characteristics of the metering orifice the force acting on the spool is directly proportional to the displacement of the spool from its neutral position.

Remote control of a valve spool, subjected to a throttling action, presents a difficult problem, since the flow forces, well known in the art, to which the throttling valve is subjected are directly proportional to the square root of the pressure differential and to the rate of fluid flow. At large pressure differentials and large rates of flow those flow forces may be equal to hundreds of pounds. If the position of the valve spool is defined by a certain level of control force or control pressure, this position will vary widely with the pressure differential of the throttled fluid.

SUMMARY OF THE INVENTION

It is a further object of this invention to provide a remote control of a position of a valve spool, which is subjected to a low level flow force, which is proportional to the displacement of the valve spool from its neutral position, irrespective of the variation in the pump and load pressures, during control of positive and negative loads.

It is a further object of this invention to provide a remote control of a valve spool, the displacement of which from its neutral position is determined by the magnitude of the force signal, irrespective of the variation in the pump and load pressure.

It is a further object of this invention to provide a remote control of a valve spool of a flow control valve controlling a load actuated by a cylinder, with compensation for different flow levels in and from the cylinder, each specific force level, applied to the valve spool, representing a specific velocity of the load in both directions of operation of the cylinder.

It is a further object of this invention to permit the positive and negative load controllers to work with similar pressure differentials providing similar flow control forces without an interaction between the controllers taking place.

Briefly the foregoing and other objects and advantages of this invention are accomplished by providing a positive load throttling compensator control upstream of the valve spool in combination with positive load metering orifice having linear flow characteristics and a negative load throttling compensator down stream of the valve spool in combination with negative load metering orifice having linear flow characteristics, both compensators performing the majority of the throttling actions and maintaining a constant pressure differential across the throttling orifice of the valve spool, during control of positive and negative load. In this way the flow forces, to which the valve spool is subjected, are low and vary proportionally with flow level, which in turn is proportional to displacement of the valve spool from its neutral position. Therefore flow force acting on the valve spool is proportional to the valve spool displacement from its neutral position and of constant rate, similar to that of conventional helical spring.

Additional objects of this invention will become apparent when referring to the preferred embodiment of the invention as shown in the accompanying drawings and described in the following description.

DESCRIPTION OF THE PREFERRED EMBODIMENT

Figure 1:
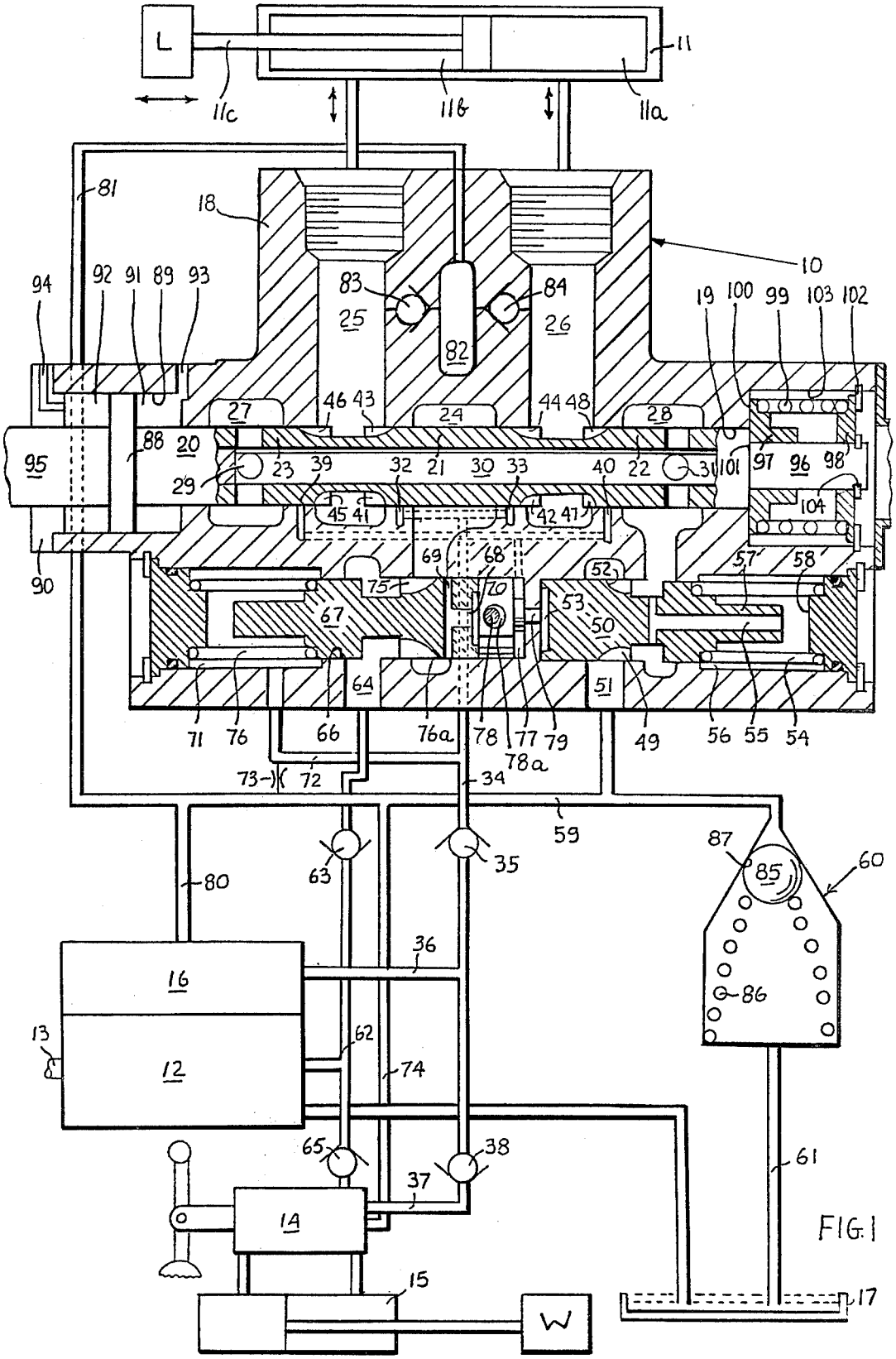
FIG. 1 is a longitudinal sectional view of an embodiment of a remotely operated flow control valve having a positive load control responsive to actuator upstream pressure differential and negative load controls responsive to actuator down stream pressure differential for use in load responsive fluid control system, with lines, system flow control, system pump, second load responsive valve, exhaust relief valve and system reservoir shown diagrammatically.

Referring now to FIG. 1, an embodiment of a flow control valve, generally designated as 10, is shown interposed between diagrammatically shown fluid motor 11 driving load L and a pump 12 of a fixed displacement or variable displacement type driven through a shaft 13 by a prime mover not shown.

Similarly, a flow control valve 14, identical to flow control valve 10, is interposed between a diagrammatically shown fluid motor 15 driving a load W and the pump 12. Fluid flow from the pump 12 to flow control valves 10 and 14 is regulated by a pump flow control 16. If pump 12 is of a fixed displacement type, pump flow control 16 is a differential pressure relief valve, which in a well known manner, by bypassing fluid from the pump 12 to a reservoir 17, maintains discharge pressure of pump 12 at a level, higher by a constant pressure differential, than load pressure developed in fluid motor 11 or 15. If pump 12 is of a variable displacement type pump flow control 16 is a differential pressure compensator, well known in the art, which by changing displacement of pump 12 maintains discharge pressure of pump 12 at a level, higher by a constant pressure differential, than load pressure developed in fluid motor 11 or 15.

The flow control valve 10 is of a fourway type and has a housing 18 provided with a bore 19 axially guiding a valve spool 20. The valve spool 20 is equipped with lands 21, 22 and 23 which in neutral position of the valve spool 20 as shown in FIG. 1 isolate a fluid supply chamber 24, load chambers 25 and 26 and outlet chambers 27 and 28. The outlet chamber 27 is connected through ports 29, central passage 30 in valve spool 20 and ports 31 to the outlet chamber 28.

Positive load sensing ports 32 and 33, located between load chambers 25 and 26 and the supply chamber 24 and blocked in neutral position of valve spool 20 by land 21, are connected through signal passage 34, a check valve 35 and signal line 36 to pump flow control 16. In a similar manner positive load sensing ports of flow control valve 14 are connected through line 37, a check valve 38 and signal line 36 to the pump flow control 16. Negative load sensing port 39 is located between load chamber 25 and outlet chamber 27. Similarly, negative load sensing port 40 is located between load chamber 26 and outlet chamber 28.

The land 21 of the valve spool 20 is equipped with signal slots 41 and 42, located in plane of positive load sensing ports 32 and 33 and metering slots 43 and 44, which, in a well known manner, can be circumferentially spaced in respect to each other and in respect to the signal slots 41 and 42. The land 23 is equipped with signal slot 45, located in plane of negative load sensing port 39 and circumferentially spaced metering slot 46. The land 22 is equipped with signal slot 47, located in plane of negative load sensing port 40 and circumferentially spaced metering slot 48. Signal slots 41, 42, 45 and 47, in a well known manner, can be substituted by end surfaces of lands 21, 22 and 23. A suitable device is provided to prevent relative rotation of the spool 20 in respect to bore 19.

The outlet chamber 28 is connected through slots 49, of a negative load control spool 50, to an exhaust chamber 51. The negative load control spool 50 having slots 49, provided with throttling edges 52, projects into control space 53 and is biased towards position, as shown, by spring 54. The negative load control spool 50 is provided with passage 55 connecting the outlet chamber 28 with space 56 and is equipped with stop 57, limiting its displacement against surface 58. The exhaust chamber 51 in turn is connected through exhaust line 59, an exhaust relief valve, generally designated as 60, and line 61 to the reservoir 17.

The pump 12, through its discharge line 62 and load check 63, is connected to a fluid inlet chamber 64. similarly, discharge line 62 is connected through load check valve 65 with the inlet chamber of the fluid control valve 14. The control bore 66 connects the fluid inlet chamber 64 with the fluid supply chamber 24. The control spool 67, axially slidable in control bore 66, projects on one end into space 68, connected to the fluid supply chamber 24 by passage 69 and abuts against a free floating piston 70. The control spool 67 on the other end projects into control space 71, which is connected by passage 72 with positive load sensing ports 32 and 33 and through leakage orifice 73 to exhaust line 59 and to upstream of exhaust relief valve 60. Similarly, control space and leakage orifice of the control valve 14 is connected by line 74 to upstream pressure of exhaust relief valve 60. The control spool 67 is provided with slots 75 terminating in throttling edges 76*a*, positioned between the inlet chamber 64 and the supply chamber 24. The control spool 67 is biased by a control spring 76 towards position, in which slots 75 connect the fluid supply chamber 24 with the fluid inlet chamber 64.

The free floating piston 70, provided with pin 78 passing through clearance hole 78*a*, on one end is subjected to pressure in space 68, which is connected to the fluid supply chamber 24 and on the other end is subjected to pressure in control space 77, which is connected to negative load pressure sensing ports 39 and 40. Surface of the free floating piston 70, in the position as shown, effectively seals port 79 and control space 53 from control space 77.

The exhaust relief valve, generally designated as 60, is interposed between combined exhaust circuits of flow control valves 10 and 14, including bypass circuit of pump 12 and reservoir 17. The pressurized exhaust circuit of flow control valve 10 includes exhaust line 59 connected to bypass line 80 and connected through line 81 to chamber 82, which is operationally connected for one way fluid flow by check valves 83 and 84 with load chambers 25 and 26. The exhaust relief valve 60 is provided with a throttling member 85, biased by a spring 86 towards engagement with seat 87.

If the pump 12 is of a fixed displacement type, excess pump flow from the differential pressure relief valve or pump flow control 16 is delivered through line 80 to the exhaust line 59 and therefore to the total pressurized exhaust circuit of flow control valves 10 and 14.

The sequencing of the lands and slots of valve spool 20 preferably is such that when displaced in either direction from its neutral position, as shown in FIG. 1, one of the load chambers 25 or 26 is first connected by signal slots 41 or 42 to the positive load sensing port 32 or 33, while the other load chamber is connected by signal slots 45 or 47 to the negative load sensing port 39 or 40, while the load chambers 25 and 26 and therefore chambers 11*a* and 11*b* are still isolated from the supply chamber 24 and the outlet chambers 27 and 28. Further displacement of the valve spool 20 from its neutral position connects load chamber 25 or 26 to the supply chamber 24 through metering slots 43 or 44, while connecting the other load chamber through metering slots 46 or 48 with one of the outlet chambers 27 or 28.

The valve spool 20 on one end is provided with an actuating piston 88, engaging a bore 89, provided in the valve housing 18. The actuating piston 88 divides the space, contained by bore 89 and cover 90, into chambers 91 and 92 communicating respectively with ports 93 and 94. A stem 95 projects through the cover 90. The other end of valve spool 20 is provided with a stem portion 96, slidably engaging spring guides 97 and 98, which locate a positioning spring 99. The spring guide 97, in the position of valve spool 20 as shown in FIG. 1, abuts against surface 100 and shoulder 101. The spring guide 98 abuts against a retaining ring 102, positioned in bore 103 and against retaining ring 104, positioned on the stem portion 96.

Figure 2:
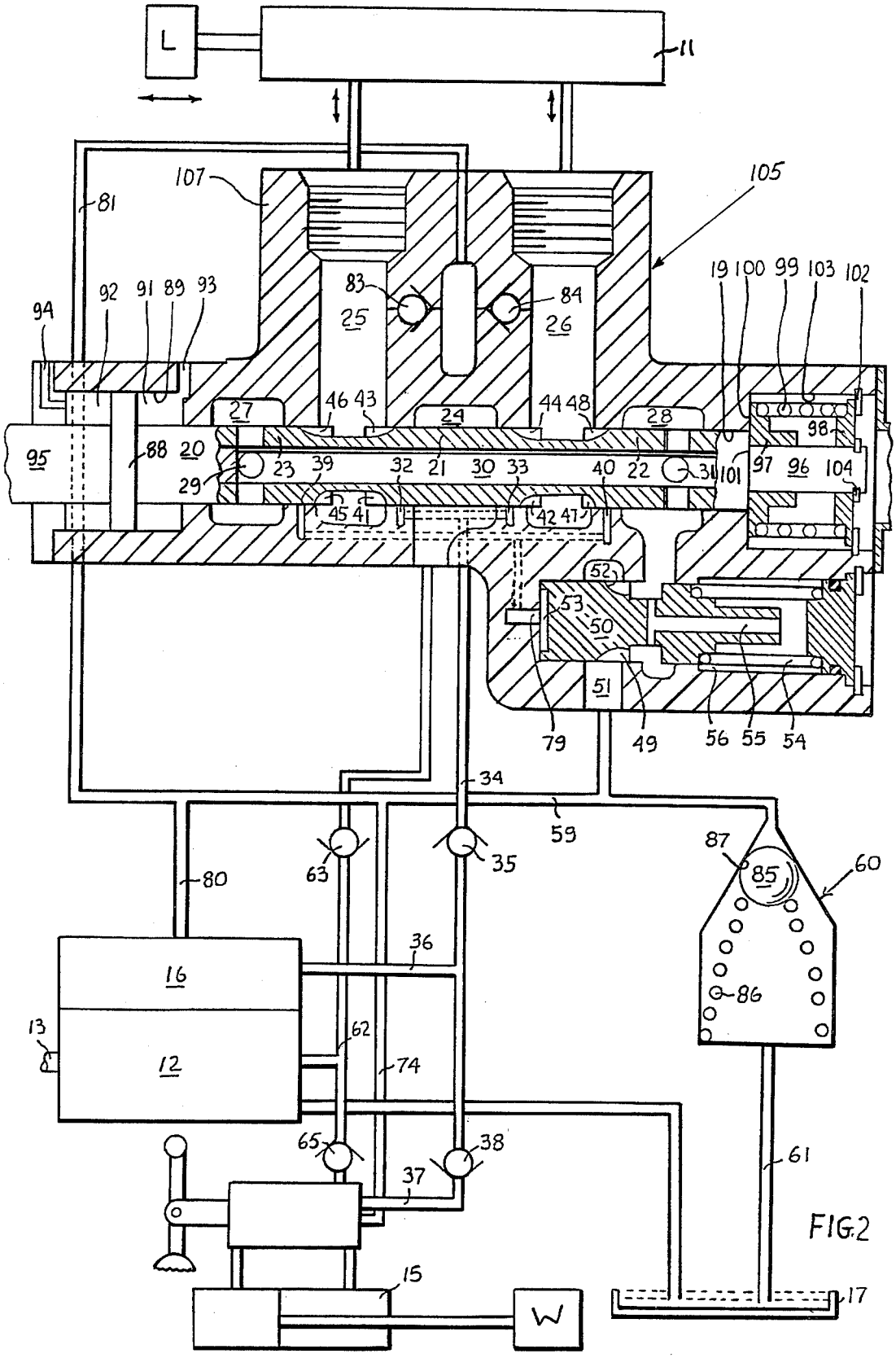
FIG. 2 is a longitudinal sectional view of an embodiment of a remotely operated load responsive flow control valve similar to that of FIG. 1 but provided only with negative load compensation, with lines, system flow controls, system pump, load responsive pump control, second load responsive valve, exhaust relief valve, exhaust unloading valve and system reservoir shown diagrammatically.

Referring now to FIG. 2 a flow control valve, generally designated as 105, is similar to flow control valve 10 of FIG. 1, the same valve components being denoted by the same numbers. A flow control valve 106, similar to the flow control valve 105, is integrated into the circuit of FIG. 2, which is similar to the circuit of FIG. 1. The flow control valve 105 is provided with a housing 107 slidably guiding valve spool 20 with its actuating piston assembly and positioning spring assembly, identical to those of FIG. 1. The negative load control spool 50, identical to that of FIG. 1, is directly connected through port 79 to the negative load sensing ports 39 and 40.

Figure 3:
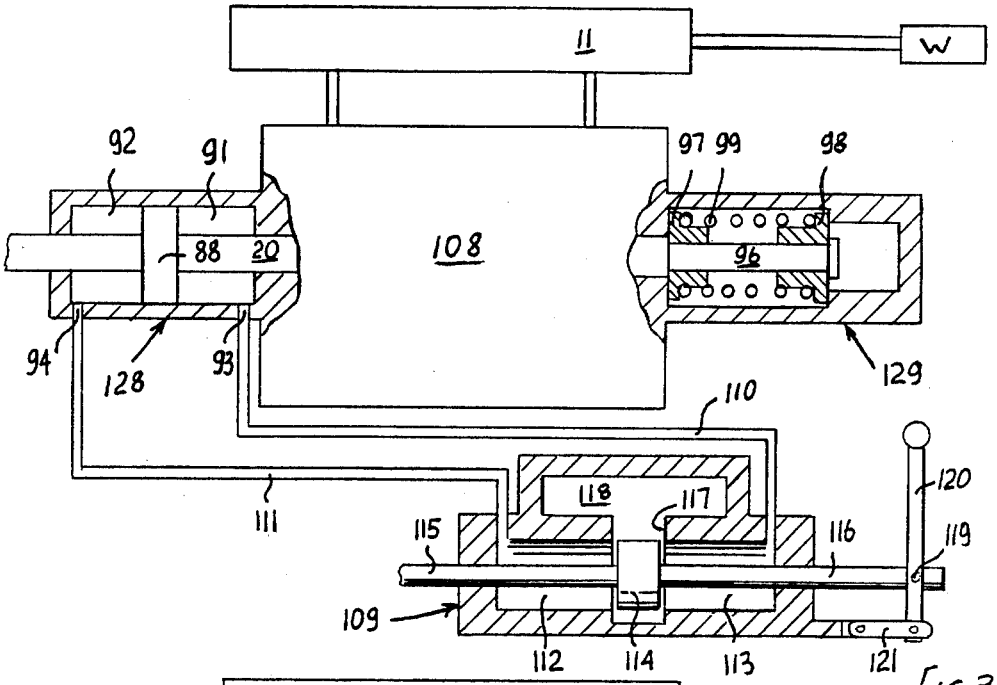
FIG. 3 is a diagrammatic representation of the flow control valve of FIG. 1 with remote control operated by manually generated fluid pressure signals.

Referring now to FIG. 3, a flow control valve 108, which can be identical to either flow control valve 10 of FIG. 1,or flow control valve 105 of FIG. 2, is provided with a remote actuator, generally designated as 109, connected by lines 110 and 111 with ports 93 and 94. The remote actuator 109 is provided with cylinders 112 and 113, slidably engaging a piston 114, by stems 115 and 116. The cylinders 112 and 113 are interrupted by a slot 117, communicating with the reservoir 118. The stem 116 is connected by pin 119 to a control lever 120, which in turn is connected by link 121 with the remote actuator assembly 109.

Figure 4:
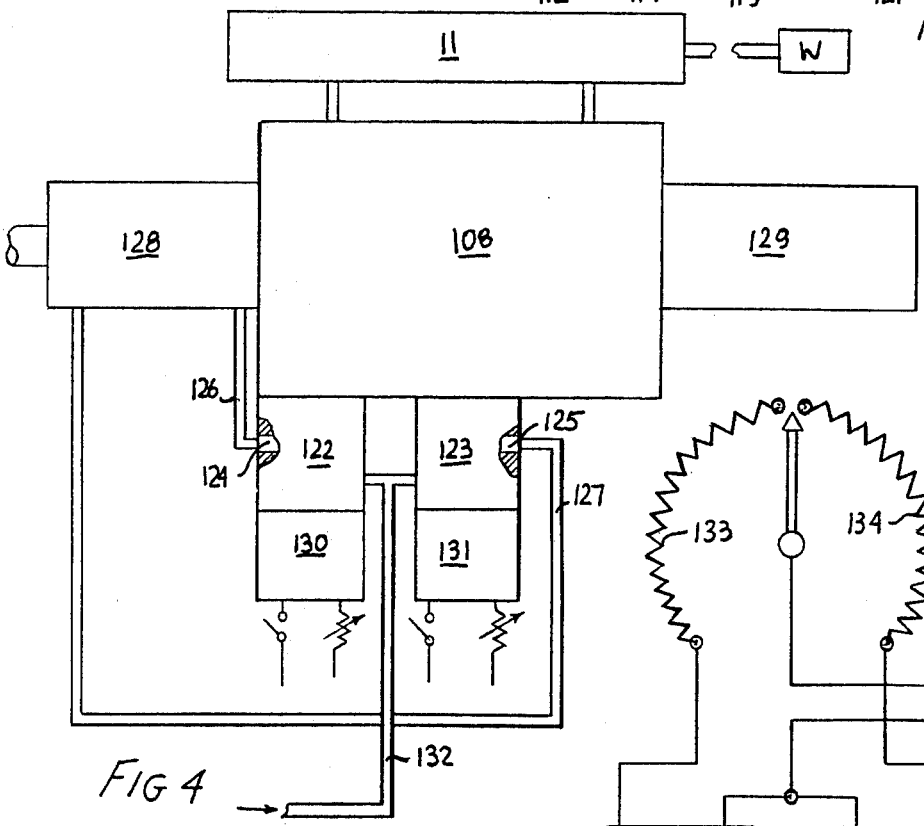
FIG. 4 is a diagrammatic prepresentation of the flow control valve of FIG. 1 with remote control, operated by electrically generated force to pressure transducer device, responsive to an electrical control signal.

Referring now to FIG. 4, the flow control valve 108, identical to flow control valve 108 of FIG. 3, is provided with pressure modulating valves 122 and 123, provided with ports 124 and 125 and connected by lines 126 and 127 with actuator assembly 128, which is identical to that of FIG. 3 and contains actuating piston 88 and chambers 91 and 92. The positioning spring assembly 129 is identical to and contains the same components, as that shown in FIG. 3. The pressure modulating valves 122 and 123 are operated by solenoids 130 and 131 respectively and can be provided with pressure fluid by conduit 132 from a pressure source not shown.

Figure 5:
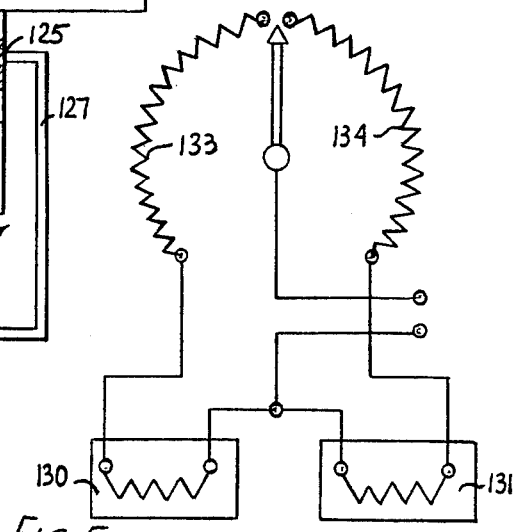
FIG. 5 is a simplified schematic diagram of the electrical control circuit.

FIG. 5 shows a simplified electrical circuit for operation of solenoids 130 and 131, the current flow through which is regulated by variable resistances 133 and 134.

Figure 6:
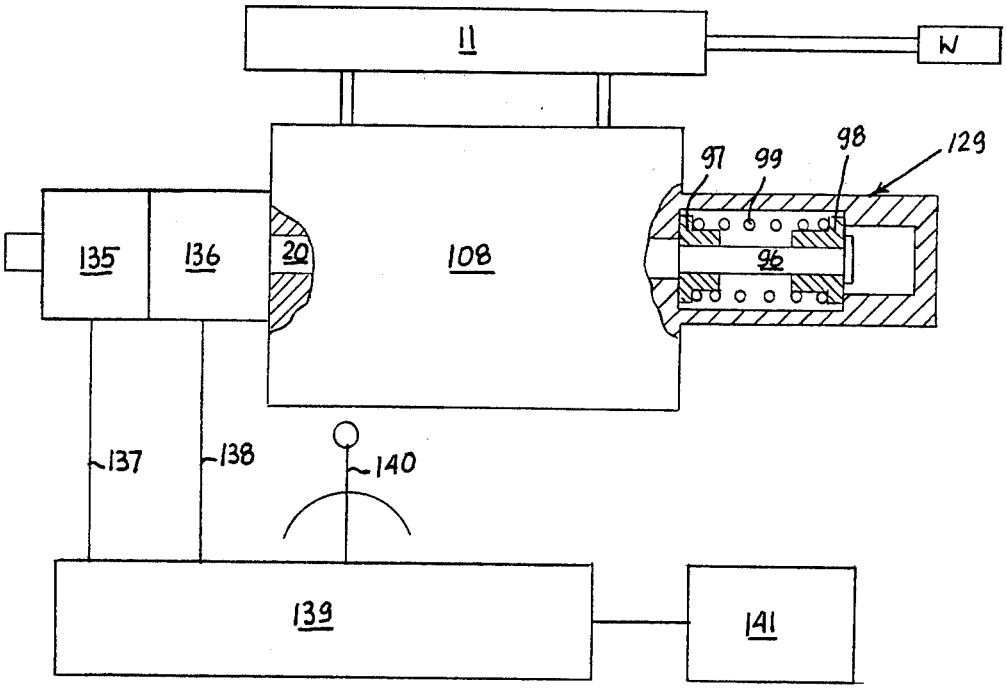
FIG. 6 is a diagrammatic representation of the flow control valve of FIG. 1 with remote control operated by a solenoid responsive to an electrical control signal.

Referring now to FIG. 6, the flow control valve 108, identical to flow control valves 108 of FIGS. 3 and 4, is provided with solenoid assemblies 135 and 136 operably connected to the valve spool 20 and connected by lines 137 and 138 with an input current control 139 operated by a control lever 140 and supplied with electrical power from an electrical power source 141. The positioning spring assembly 129 is identical to and contains the same components as that shown in FIGS. 3 and 4.

Figure 7:
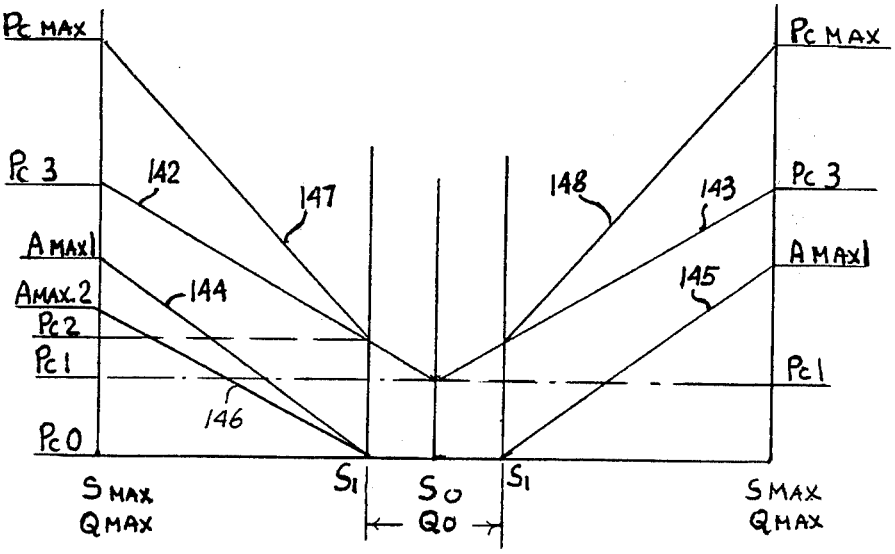
FIG. 7 is a graph of control pressure and orifice area plotted on the base of spool control stroke and controlled flow through the valve.

Referring now to FIG. 7 the control pressure Pc and orifice area A are plotted on the base of valve spool stroke S and valve controlled flow level Q. Lines 144, 145 and 146 represent area of metering orifices when plotted on the base of the valve stroke. Lines 142 and 143 represent the control pressure necessary to move the valve spool against force of the return spring plotted on the base or stroke of flow. Lines 147 and 148 represent control pressures equivalent to the combined return spring and flow forces acting on the valve spool plotted on the base of valve spool stroke and also on the base of the controlled flow level through the valve.

Figure 8:
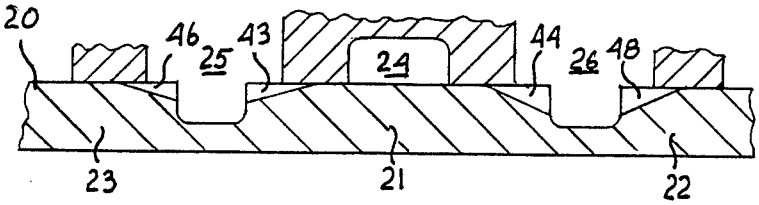
FIG. 8 is a partial section showing enlarged metering slots of valve spool of FIG. 1.

Referring now to FIG. 8 metering slots 43, 46, 44 and 48 of the valve spool 20 of FIG. 1 are shown enlarged.

Referring now to FIG. 1, with pump 12 of a fixed displacement type started up the pump flow control 16 will bypass through line 80, exhaust line 59, the exhaust relief valve 60 and line 61 all of pump flow to the system reservoir 17 at minimum pressure level equivalent to preload in the spring 86, while automatically maintaining pressure in discharge line 62 at a constant pressure, higher by a constant pressure differential, than pressure in signal line 36 or pressure in exhaust line 59. Therefore all of the pump flow is diverted by the pump flow control 16 To the low pressure exhaust circuit, as previously described, without being used by flow control valves 10 and 14. Since signal line 36 is connected by passage 72 with control space 71, which is also connected through leakage orifice 73 to upstream of exhaust relief valve 60, the bypass pressure in the discharge line 62 will be higher, by a constant pressure differential, than the pressure in exhaust line 59, which equals the pressure setting of the exhaust relief valve 60. This pump bypass pressure transmitted through passage 69 to space 68 reacts on the cross-sectional area of control spool 67 and against the bias of control spring 76 to move the control spool 67 from right to left, closing with throttling edges **76*a* the passage between the inlet chamber 64 and the supply chamber 24**.

With pump 12 of a variable displacement type, under working conditions, minimum flow to the system exhaust manifold composed of lines 80, 74, exhaust line 59 and exhaust pressure relief valve 60, may have to be diverted from the pump 12, to maintain the system exhaust manifold pressurized. A pressure reducing type regulator can be used, which upon system exhaust manifold pressure dropping below the setting of the exhaust pressure relief valve 60, will throttle some of the pump discharge flow and supply it to the exhaust manifold, to maintain it at a certain preselected minimum pressure level.

Assume that the load chamber 25 and the chamber **11*b* are subjected to a positive load pressure. The initial displacement of the valve spool 20 to the right will connect the load chamber 25 and chamber 11*b* through signal slot 41 with positive load sensing port 32, while lands 21, 22 and 23 still isolate the supply chamber 24, load chambers 25 and 26 and outlet chambers 27 and 28. As previously described positive load signal transmitted from positive load sensing port 32, through signal passage 34, check valve system and signal line 36 to the pump flow control 16 will increase the pressure in discharge line 62 to a level, which is higher by a constant pressure differential than the load pressure signal. The load pressure, transmitted through passage 72 to control space 71, will move the positive load control spool 67 to the right, opening through slots 75 communication between the inlet chamber 64 and the supply chamber 24. Communication will be maintained between the supply chamber 24 and the inlet chamber 64, as long as the pump flow control 16** maintains a constant pressure differential between the pump discharge pressure and the positive load pressure.

Further displacement of the valve spool 20 to the right will connect the load chamber 25 and the chamber 11*b*, through metering slot 43, with the supply chamber 24 and will also connect through metering slot 48 the load chamber 26 and the chamber 11*a* with the outlet chamber 28. In a manner as previously described, the pump flow control 16 will maintain a constant pressure differential across orifice, created by displacement of metering slot 43, the flow into the load chamber 25 and the chamber 11*b* being proportional to the area of the orifice and therefore displacement of the valve spool 20 from its neutral position and independent of the magnitude of the load L. During control of positive load the free floating piston 70 is subjected to pressure in the supply chamber 24 and through negative load sensing port 40 to the low pressure in the load chamber 26. This pressure differential maintains the free floating piston 70 to the right closing communication between control spaces 77 and 53, effectively deactivating the negative load control spool 50. While a controlled fluid flow is supplied from the pump circuit to the chamber 11*b*, a flow, larger by displacement of piston rod 11*c* will be displaced from the chamber 11*a* and will be delivered through load chamber 26, metering slot 48, the outlet chamber 28 and slots 49 to the exhaust chamber 51 and therefore to the exhaust circuit.

Assume that while controlling positive load L through the flow control valve 10, a higher positive load W is actuated through the flow control valve 14. Higher load pressure signal from the flow control valve 14 will be transmitted through the check valve system and signal line 36 to the pump flow control 16, which will now maintain system pressure, higher by a constant pressure differential, than pressure generated by positive load W. In a manner as previously described, the pressure drop through metering slot 43 will increase, therefore increasing the pressure differential between space 68 and control space 71. The positive load control spool 67 will move into its modulating position, throttling with throttling edges 76*a* the fluid flowing from the inlet chamber 64 to the supply chamber 24, to maintain a constant pressure differential between the supply chamber 24 and the load chamber 25, thus controlling fluid flow through metering slot 43. While this throttling control action takes place, control space 77 is connected through the negative load pressure sensing port 40 with low pressure existing in the load chamber 26. Free floating piston 70, subjected to pressure in the supply chamber 24 is maintained to the right and closes port 79, leading to control space 53. In this way negative load control spool 50 becomes isolated from the negative load pressure signal and the negative load control spool 50 must remain inactive during control of positive load. This action of free floating piston 70 provides an effective interlock between positive and negative load controllers.

Assume that the load chamber 26 is subjected to a negative load L and that the valve spool 20 is displaced from its neutral position to the right while, as previously described, the positive load control spool 67 is maintained by the pump standby pressure in a position blocking communication between the inlet chamber 64 and the supply chamber 24. Initial displacement of the valve spool 20 will connect through signal slot 41 the load chamber 25 with the positive load sensing port 32. Since the load chamber 25 is subjected to low pressure neither the pump flow control 16 nor the positive load control spool 67 will react to it. Simultaneously signal slot 47 will be connected to the negative load sensing port 40, connecting the load chamber 26, subjected to negative load pressure through signal passages with control space 77. Since the control spool 67, biased by control spring 76, is contacting the free floating piston 70, the pressure differential, developed between control space 71 and control space 77 will move the free floating piston 70 within clearance between pin 78 and hole 78*a* to the left, opening port 79, cross-connecting control space 77 with control space 53. Under action of negative load pressure, supplied from the negative load pressure sensing port 40, the free floating piston 70 will be maintained in this position. At the same time negative load pressure from control space 77, transmitted through port 79 to control space 53, reacting on the cross-sectional area of negative load control spool 50 will move it, against the biasing force of spring 54, all the way to the right, with throttling edges 52 cutting off communication between the outlet chamber 28 and the exhaust chamber 51.

Further displacement of valve spool 20 to the right will connect through metering slot 48 the load chamber 26 with the outlet chamber 28, while also connecting through metering slots 43 the load chamber 25 with the supply chamber 24. Since the outlet chamber 28 is isolated by position of the negative load control spool 50, the pressure in the outlet chamber 28 will begin to rise, until it will reach a level, at which force generated on the cross-sectional area of the negative load control spool 50, by the pressure in control space 53, will equal the sum of the force generated on the same cross-sectional area by the pressure in the outlet chamber 28 and therefore pressure in space 56 and the biasing force of the spring 54. At this point the negative load control spool 50 will move from right to left, into a modulating position, in which fluid flow from the outlet chamber 28 to the exhaust chamber 51 will be throttled by the throttling edges 52, to automatically maintain a constant pressure differential, equivalent to biasing force of the spring 54, between the load chamber 26 and the outlet chamber 28 and therefore across metering orifice of metering slot 48. Since during control of negative load a constant pressure differential is maintained across the orifice, created by the displacement of metering slot 48, by the throttling action of negative load control spool 50, fluid flow through metering slot 48 will be proportional to the displacement of the valve spool 20 and constant for each specific position of metering slot 48, irrespective of the change in the magnitude of the negative load L. Since through positive load signal slot 41 and load sensing port 32 low pressure in the load chamber 25 will communicate with control space 71 the control spool 67, in a well known manner, will act as a constant pressure reducing valve, maintaining the supply chamber 24 at a constant pressure level, equivalent to preload in control spring 76. Therefore a constant pressure differential will be maintained across metering slot 43.

Part of the inlet flow requirement of load chambers 25 and 26 may be supplied through check valves 83 and 84 from the outlet flow from one of the load chambers and total system exhaust flow available from the exhaust manifold, pressurized by the exhaust relief valve 60. The pressure setting of the exhaust relief valve 60 is high enough to provide the necessary pressure drop through check valve 83, at the highest rates of flow from the exhaust manifold to the load chamber 25, without pressure in the load chamber 25 dropping below atmospheric level, thus preventing any possibility of cavitation. In this way, during control of negative load, inlet flow requirement of the actuator may be partially supplied from the pump circuit and partially from the pressurized exhaust circuit of flow control valves 10 and 14. If negative load pressure is not sufficiently high to provide constant pressure drop through metering slot 48, the negative load control spool 50 will move to the left from its modulating and throttling position, the negative load pressure in the load chamber 26 and control space 77 will drop to a level at which the pressure in space 68, will become higher than pressure in control space 77. The free floating piston 70 will move to the right closing port 79. The check valve 83 will close and the control system will revert to its positive load mode of operation, providing the energy to load L from the pump circuit to maintain a constant pressure differential across metering slot 43, which will also maintain a constant pressure differential across metering slot 48. During control of negative load the inlet flow requirement of the actuator may be supplied partially from the pump and partially from the outlet flow from the actuator, bypass flow from the pump flow control and the exhaust circuits of all of the other system flow control valves through check valves 83 and 84.

During control of negative load, with valve spool 20 displaced to the left, the metering slot 46 throttles the oil flow to outlet chamber 27 and this flow is supplied through ports 29, central passage 30 in valve spool 20 and ports 31 to the outlet chamber 28. Therefore ports 29, central passage 30 and ports 31 cross-connect outlet chambers 27 and 28 permitting bidirectional control of negative load.

In a manner as previously described, when controlling a positive load, flow control valve 10 will always maintain a constant pressure differential between supply chamber 24 and load chambers 25 and 26. Therefore, for each specific area of orifice created by displacement of metering slot 43 or 44, between supply chamber 24 and load chamber 25 or 26, a constant flow will be exchanged between those chambers. Since the pressure differential is always maintained constant, the area of flow orifice of metering slot 43 or 44 will determine the quantity of flow passing through the orifice. The flow force, acting on spool 20, due to metering slot 43 or 44, is proportional to the flow and the square root of the pressure differential acting across the orifice. Since the pressure differential is always maintained constant, the flow force, acting on the valve spool 20, will be proportional to flow and therefore to the area of the orifice, created by displacement of metering slot 43 or 44. Assume that the area of metering slot 43 or 44 varies linearly with displacement of the spool 20, each increase in displacement proportionally increasing the flow area. Then the flow force will vary in a linear fashion with displacement of valve spool 20, starting from zero and increasing to its maximum value. Assume that the inlet flow to the motor 11 is equal to its outlet flow. Then the flow through metering slot 43 or 44 into the motor 11 must be equal to the flow through the metering slot 46 or 48 out of the fluid motor 11. Assume that slots 43, 44, 46 and 48 are identical. Therefore with the same flow passing through each pair of metering slots, the same pressure differential will be maintained. As is well known in the art, the flow force always acts in the direction of closing of the orifice. Therefore flow forces acting on the valve spool 20, due to flow through the metering orifices 43 and 48 or 44 and 46, will add to each other and produce a combined linear flow force, proportional to displacement of the valve spool 20 from its neutral position. Since the combined flow force is linear and proportional to the spool displacement, it acts in an identical way as a helical spring of a constant rate. Therefore the flow force, when combined with the force of the positioning spring 99, will still be linear in respect to displacement of the valve spool 20. Therefore each displacement of the valve spool 20 will correspond to a specific resisting force, which corresponds to a specific control pressure acting on actuating piston 88. When referring to FIG. 7 control pressure Pc, proportional to the sum of flow forces and biasing force of positioning spring 99, is plotted on the base of controlled flow Q through the valve, proportional to the area of the metering orifices A and therefore proportional to the displacement of the valve spool 20 from its neutral position S. Pc is the control pressure which, when reacting on the effective area of actuating piston 88, will move the valve spool 20 in either direction to a specific required position, against the biasing force of positioning spring 99 and the combined flow forces, generated by the controlled flow. Lines 142 and 143 of FIG. 7 show the control pressure Pc required to move valve spool 20 from its neutral position, equivalent to position So in either direction against the biasing force of the positioning spring 99, with flow forces being equal to zero. Control pressure Pcl is equivalent to the preload in the positioning spring 99. Control pressure Pc2 is the pressure necessary to compress the positioning spring 99 through a stroke S1, which is equivalent to the dead band of the valve spool 20, well known in the art. Control pressure Pc3 is the pressure necessary to fully compress positioning spring 99 at maximum spool stroke in either direction from its neutral position. As previously described, the flow area of metering slots 46, 43, 44 and 48 varies in a linear fashion in respect to displacement of the valve spool 20. Such a relationship is shown by lines 144, 145 and 146, which show increase in the flow area from the position S1, equivalent to dead band, to S max. proportional to the maximum displacement of the valve spool 20. Each specific area in respect to displacement of the valve spool 20, as shown by the lines 144, 145 and 146, with constant pressure differential being maintained, represents a specific flow force. The sum of those combined flow forces, acting on the valve spool 20, together with the biasing force of the positioning spring 99, is equivalent to Pc pressure required to position the spool and is shown by lines 147 and 148. At Pc max. control pressure the valve spool 20 will be positioned at its maximum displacement and subjected to maximum flow force and maximum biasing force of the positioning spring 99. So far it was assumed that the flow in and out of the motor 11, in both directions of operation, is equal. Actually when referring to FIG. 1 the flow out of the chamber **11*b* of fluid motor 11 is smaller by the flow, equivalent to the displacement of the piston rod 11*c*, than the inlet flow to the chamber 11*a*. To compensate for this difference in flow between motor inlet and outlet, the flow area of the selected metering slots varies in a manner as shown by lines 145 and 146. The area versus spool displacement characteristics of the metering slots 44 and 48, handling the larger flow from the chamber 11*a*, is shown by line 145. The area versus spool displacement characteristics of metering slots 46 and 43, handling the smaller flow from the chamber 11***b*, is shown by line 146. The ratio of the areas between metering slots 44 and 48 and metering slots 46 and 43 is so selected that it is equal to the ratio of the fluid displacement from the chamber 11*a* to the fluid displacement from the chamber 11*b*. In this way, by selection of the flow characteristics of individual metering slots the effect of the different flows from fluid motor ports in the form of a cylinder can be compensated as shown by lines 147 and 148 of FIG. 7. Therefore in both directions of actuation of fluid motor 11 each specific level of control pressure Pc will represent a specific velocity of load L, irrespective of the magnitude of the pump and load pressures, while controlling both positive and negative loads.

Assume that metering slots 46, 43, 44 and 48 are identical and that the valve spool 20 controls a fluid motor in the form of a cylinder, with different flows in and out of chambers 11*b* and 11*a*. Then, when controlling the flow into chamber 11*b* during positive load control, the valve spool 20 will be subjected to a larger flow force than that shown in FIG. 7. When controlling flow out of the chamber 11*b*, during negative load control, the valve spool 20 will be subjected to a smaller flow force than that shown in FIG. 7, or to a flow force equal to that shown in FIG. 7, depending on the pressure setting of the exhaust relief 60. When controlling the flow into the chamber 11*a*, during positive load control, the valve spool 20 will be subjected to a smaller flow force than that shown in FIG. 7. When controlling the flow out of the chamber 11*a*, during negative load control, the valve spool 20 will be subjected to a smaller flow force than that shown in FIG. 7. Thus the benefit of compensation of the flow areas of the metering slots 44 and 48, as previously discussed, becomes self-evident. Compensated metering slots 44 and 48 of FIG. 1 are shown enlarged in FIG. 8 and correspond to the variation in flow areas as shown by lines 144 and 145 of FIG. 7. Variation in flow areas of slots 43 and 46 of FIG. 8 is shown by line 146 of FIG. 7.

Referring now to FIG. 2, the constant pressure differential between the fluid supply chamber 24 and load chambers 25 and 26 is automatically maintained by the output flow control 16 of pump 12. If pump 12 is a fixed displacement type the output flow control 16 becomes a differential pressure bypass valve and will bypass a sufficient quantity of flow delivered from the pump 12 through line 80 into the exhaust system to maintain a constant pressure differential between pressure in discharge line 62 and load pressure signal transmitted through signal line 36.

If the pump 12 is of a variable displacement type, the output flow control 16 in the form of a differential pressure compensator will vary the pump displacement to automatically maintain a constant pressure differential between the pressure in the discharge line 62 and the load pressure in the signal line 36.

The negative load compensator of flow control valve 10 of FIG. 1 is identical to negative load compensator of flow control valve 105 of FIG. 2. In a manner as previously described when referring to FIG. 1 the negative load compensator with its negative load control spool 50 will automatically throttle the outlet flow to maintain a constant pressure differential between load chamber 25 or 26 and outlet chamber 28.

The compensation of the flow forces of the valve spool 20 of FIG. 2 is identical to that as described when referring to FIG. 1 and FIG. 7.

Although the flow control valves of FIGS. 1 and 2 will perform in an identical way when responding to a pressure control signal in control of load L, there is one basic difference between those two embodiments. The flow control valve 10 of FIG. 1 with its positive load compensator is capable of proportionally controlling a positive load irrespective of the pump pressure. Therefore a multiplicity of loads can be simultaneously proportionally controlled from the same pump. When using a flow control valve 105 of FIG. 2 only one positive load at a time can be proportionally controlled since the function of maintaining the constant pressure differential between the pump pressure and the load pressure is performed by the pump control.

Referring now to FIG. 3 the flow control valve 108 is either of the type shown in FIG. 1 or of the type shown in FIG. 2, with valve spool 20 subjected to the same type of flow and spring return forces as described in detail when referring to FIG. 1 and FIG. 7. The displacement of piston 114 in either direction past slot 117 will displace a quantity of fluid from cylinder 112 or 113 through lines 111 or 110 to chamber 92 or 91 to position the actuating piston 88. The displacement of the actuating piston 88 and therefore valve spool 20 from its neutral position, as shown in FIG. 3, will be opposed by the force due to positioning spring 99 and flow forces acting on valve spool 20 and will correspond to a certain specific level of control pressure in the chamber 92 or 91. Therefore for each specific force level applied to control lever 120 the actuating piston 88 will be displaced through a specific distance corresponding to a specific level of controlled flow into fluid motor 11 and corresponding to a specific velocity of load W in both directions of operation of fluid motor 11.

Referring now to FIG. 4 the flow control valve 108 identical to flow control valve 108 of FIG. 3 may be of the type as shown in FIG. 1 or FIG. 2. The actuator assembly 128 and the positioning spring assembly of FIG. 4 are identical to those of FIG. 3. The flow control valve 108 of FIG. 4 is provided with pressure modulating valves 122 and 123 provided with ports 124 and 125 and connected by lines 126 and 127 with actuator assembly 128, which as previously mentioned is identical to that of FIG. 3 and contain actuating piston 88 and chambers 91 and 92. The valve spool of the flow control valve 108 is subjected to identical forces and is compensated in an identical way as valve spool 20 of FIG. 1. The pressure modulating valves 122 and 123 are operated by solenoids 130 and 131 respectively and can be provided with pressure fluid by conduit 132 from a pressure source not shown. Solenoids are electromechanical devices using the principle of electro-magnetics to produce output forces from electrical input signals. The force output of the solenoid is a function of input current. The pressure modulating valves 122 and 123 are of a type well known in the art which produce an output pressure proportional to the magnitude of the applied mechanical force. All pressure reducing valves belong to this family of valves. The solenoids 130 and 131 as previously mentioned are transducers which convert an electrical signal into proportional mechanical force. Therefore the pressure modulating valves 122 and 123 in combination with solenoids 130 and 131 will provide a pressure output proportional to the electrical signal. Therefore each specific electrical current supplied to the solenoids 130 and 131 will result in a specific pressure transmitted to the actuator assembly 128 which in turn will produce a specific velocity of load W through the control action of flow control valve 108, previously described when referring to FIG. 1.

Referring now to FIG. 5 in the simplified electrical circuits of solenoids 130 and 131 the electrical current supplied to solenoids 130 and 131 in a well known manner is regulated by variable resistances 133 and 134.

Referring now to FIG. 6 the flow control valve 108 is identical to flow control valve 108 of FIGS. 3 and 4 and may be of a type as shown in FIG. 1 or 2. The positioning spring assembly 129 is identical to that of FIG. 1. Therefore valve spool 20 will be subjected to identical spring biasing and flow forces as valve spool 20 of FIG. 1 which are illustrated in graph form in FIG. 7. Therefore each specific force level applied to valve spool 20 will result in a specific displacement of valve spool 20 from its neutral position corresponding to a specific flow through flow control valve 108 and specific velocity of load W. In a manner as previously described when referring to FIG. 1 the flow control valve 108 is compensated for different flows in and out of the fluid motor 11 to control the velocity of the load W in an identical way in both directions of its operation.

Solenoids 135 and 136 are directly coupled to valve spool 20. As previously mentioned, when referring to FIG. 4, solenoids are electro-mechanical devices using the principle of electro-magnetics, to produce output forces from electrical input signals. The position of solenoid armature, when biased by a spring, is a function of the input current. As current is applied to the coil, the resulting magnetic forces generated move the armature from its deenergized position to its energized position. When biased by a spring, for each specific current level there is a corresponding particular position, which the solenoid will attain. As current is varied from zero to maximum rating, the armature will move one way from a fully retracted to a fully extended position in a predictable fashion, depending on the specific level of current at any one instant. The current level may be varied up and down in any fashion and the armature will follow according to the current supply. The armature of the solenoid is directly mechanically coupled to the valve spool 20 of the flow control valve 108 which, as previously described, is subjected to a total linear force composed of flow force displaying constant rate characteristics supplemented by the centering force of a spring, which adds to it. Therefore each specific current level will represent a specific force transmitted to the armature and therefore to the valve spool 20, which in turn will result in a specific position of the valve spool 20 and a specific constant flow level of the fluid through the flow control valve 108, irrespective of the magnitude of the pressure level, to which the valve spool is subjected. When using a dual coil bidirectional solenoid with the centering spring arrangement of FIG. 1, flow out of the fully compensated load responsive valve can be controlled in both directions of operation.

Solenoids 135 and 136 are connected by lines 137 and 138 with an input current control 139 operated by a control lever 140 and supplied with electrical power from an electrical power source 141.

Referring now to FIGS. 1 and 7, the spring characteristics of springs 76 and 54 of FIG. 1 will affect directly the relatively constant pressure differential of the positive and negative load controllers and consequently will affect the slope of the lines 147 and 148 of FIG. 7. For the slopes of lines 147 and 148 to be the same, springs with similar characteristics should be used in positive and negative load controllers. This normally would provide an interference between controllers, when controlling a positive load. By use of the free floating piston 70, see FIG. 1, which acts as an interlock between the controllers, identical springs and pressure differentials can be used for both of the controllers, since negative load controller becomes, automatically deactivated, when the flow control valve 10 is controlling a positive load. In this way the slope of the lines 147 and 148 of FIG. 7 can be controlled and made the same, without introduction of interference, due to action of negative load controller, while controlling a positive load.

Although the preferred embodiment of this invention has been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly comprising a housing having a supply chamber communicable with a pump, first and second load chambers, and fluid exhaust means, first valve means for selectively interconnecting said load chambers with said supply chamber and said fluid exhaust means, fluid metering means on said first valve means, positive load flow force limiting means of said first valve means including positive load control means to limit pressure differential acting across said metering orifice means to a predetermined relatively constant level when said supply chamber is connected to one of said load chambers and said load chamber is pressurized, negative load flow force limiting means of said first valve means including negative load control means having throttling means to limit pressure differential across said metering orifice means to a predetermined relatively constant level when one of said load chambers is connected to said exhaust means and said load chamber is pressurized, spring biasing means to bias said first valve means in direction to reduce effective flow area of said metering orifice means, actuating means on said first valve means having force generating means responsive to a control signal and control signal generating means operable to transmit control signal to said force generating means of said actuating means, whereby said first valve means will assume a flow control position proportional to said control signal and independent of the magnitude of said positive and said negative loads.

2. A valve assembly as set forth in claim 1 wherein said housing has positive load sensing means selectively communicable with said load chambers by said first valve means and operable to transmit load pressure signal to said pump, said pump having output flow control means responsive to said load pressure signal.

3. A valve assembly as set forth in claim 2 wherein said output flow control means includes a bypass means having means responsive to said load pressure signal.

4. A valve assembly as set forth in claim 2 wherein said output flow control means includes a pump displacement changing means having means responsive to said load pressure signal.

5. A valve assembly as set forth in claim 1 wherein said positive load control means has fluid throttling means.

6. A valve assembly as set forth in claim 1 wherein said positive load control means includes output flow control means of said pump.

7. A valve assembly as set forth in claim 1 wherein said control signal generating means includes means to convert electrical control signal into proportional pressure signal and said force generating means includes means responsive to fluid pressure.

8. A valve assembly as set forth in claim 1 wherein said control signal generating means includes means to convert mechanical signal into fluid pressure and flow and said force generating means includes means responsive to fluid pressure.

9. A valve assembly as set forth in claim 1 wherein said control signal generating means includes means to generate an electrical signal and said force generating means includes transducer means operable to convert said electrical signal into mechanical force signal.

10. A valve assembly as set forth in claim 1 wherein said metering orifice means includes means operable to vary area of fluid flow proportionally to displacement of said first valve means.

11. A valve assembly as set forth in claim 1 wherein said spring biasing means has means operable to bias said first valve means into an isolating position to isolate said load chambers from said supply chamber and said exhaust means.

* * * * *